US010723006B2

(12) United States Patent
Thiyagarajan

(10) Patent No.: US 10,723,006 B2
(45) Date of Patent: Jul. 28, 2020

(54) STAPLER DEVICE WITH VIEWING WINDOW AND INTEGRATED STAPLE REMOVAL TOOL

(71) Applicant: Amritha Thiyagarajan, Sydney (AU)

(72) Inventor: Amritha Thiyagarajan, Sydney (AU)

( * ) Notice: Subject to any disclaimer, the term of this patent is extended or adjusted under 35 U.S.C. 154(b) by 274 days.

(21) Appl. No.: 15/801,597

(22) Filed: Nov. 2, 2017

(65) Prior Publication Data

US 2018/0117750 A1 May 3, 2018

Related U.S. Application Data

(60) Provisional application No. 62/416,531, filed on Nov. 2, 2016.

(51) Int. Cl.
*B25C 5/16* (2006.01)
*B25C 11/00* (2006.01)
*B25C 5/02* (2006.01)

(52) U.S. Cl.
CPC ..... *B25C 5/1689* (2013.01); *B25C 5/025* (2013.01); *B25C 11/00* (2013.01)

(58) Field of Classification Search
CPC ..... B25C 5/025; B25C 5/1689; B25C 5/06; B25C 5/02
See application file for complete search history.

(56) References Cited

U.S. PATENT DOCUMENTS 4,619,392 A * 10/1986 Won ..... B25C 5/1679 227/113
4,925,082 A * 5/1990 Kim ..... B25C 5/025 206/340
5,441,191 A 8/1995 Linden
5,992,724 A * 11/1999 Snyder ..... B25C 5/1689 227/120
6,089,435 A * 7/2000 Malek ..... B25C 11/02 227/156
6,244,489 B1 * 6/2001 Laurie ..... B25C 5/025 227/134
D544,769 S 6/2007 Bhavnani
7,296,720 B2 11/2007 Kirby
7,922,057 B2 * 4/2011 Ambjornsson ..... B25C 11/00 227/119
2002/0166884 A1 * 11/2002 Luo ..... B25C 5/0228 227/131
2003/0197045 A1 * 10/2003 Luo ..... B25C 5/0228 227/2
2007/0040155 A1 * 2/2007 Pan ..... B25C 11/00 254/28
2008/0308596 A1 * 12/2008 Gardner ..... B25C 5/025 227/120
2009/0050669 A1 * 2/2009 Zolentroff ..... B25C 5/0242 227/129

* cited by examiner

*Primary Examiner* — Andrew M Tecco
*Assistant Examiner* — Nicholas E Igbokwe
(74) *Attorney, Agent, or Firm* — Greg N. Geiser; Gutwein Law

(57) ABSTRACT

A device functioning as a stapler. The device including a viewing region within an arm of the stapler. The viewing region adapted to provide a user of the device with a view of an interior of a magazine within the arm of the stapler, wherein a user of the device can determine the amount of staples within the magazine without having to open the device. The device further includes an integrated staple removal tool received within a base portion of the device.

2 Claims, 6 Drawing Sheets

STAPLER DEVICE WITH VIEWING WINDOW AND INTEGRATED STAPLE REMOVAL TOOL

CROSS REFERENCE TO RELATED APPLICATIONS

This application claims priority to U.S. Provisional Patent Application No. 62/416,531 filed 2 Nov. 2016 to the above named inventor, and is herein incorporated by reference in its entirety.

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

The present disclosure relates generally to a stapler having a housing adapted for the viewing of staples during use and including an integrated staple removal tool.

BACKGROUND OF THE INVENTION

The stapler as it is known within the art is most generally a device adapted to fasten a U-shaped metal fastener referred as a staple to secure adjoining objects, such as individual sheets of paper. Staples are generally comprised of a crown portion coupled to a pair of opposed legs with the ends of legs extending opposite the crown and generally having a point or sharpened end adapted to pierce an object the staple is placed within. Staples are typically provided in a strip wherein individual staples are separated from the strip during use in fastening.

Current staplers in the art are generally comprised of an arm portion in hinged communication with a base portion. The staples are generally positioned within a magazine pivotally received within the arm portion and manipulated though a movable carriage in resilient communication with an end of the magazine adjacent a hinged connection with the base portion though a spring. A tooth is typically placed within an underside of the arm portion and adapted to strike the crown portion of an individual staple when the arm portion is generally manipulated in a direction towards the objects to be adjoined. As the staple penetrates the object being fastened, the opposed legs of the staple are compressed into an anvil portion of the base portion on an opposed side of the object to be fastened to bend the legs against the object in a secure coupling.

Typically, the staples placed within a given stapler are provided in the strip within the magazine and generally replaced when the magazine is empty. Sometimes during use, the staples become jammed or stuck within the magazine. To determine if the stapler is empty or jammed, a user is required to separate the pivotal assembly of the arm and magazine to visually inspect the magazine and determine if the device is jammed or the addition of staples is necessary.

Accordingly, it would be advantageous for the user of a stapler to have the ability to view the amount of staples present within the stapler or determine if the stapler is jammed without having to open the stapler. Still further, it would be advantageous to have a stapler that included a removable staple removal tool and staple jam removal tool integrated within a base portion of the stapler.

SUMMARY OF THE INVENTION

The present disclosure provides a stapler device. The device functions mechanically similar to a typical stapler as is found in the prior art, but with at least a portion of the device providing a user of the device a view of an interior portion of the device that can be utilized to view installed staples within the device interior during use.

The device is comprised of a base portion generally adapted to provide resting support for the device during use when placed on a surface and an arm portion in hinged coupling with the base portion.

The base portion having a first end and a second end opposite the first end and defining a length of the device, wherein the first end is positioned adjacent to the hinged coupling with the arm portion.

The second end of the base portion comprising a first foot and a second foot, the first foot and the second foot generally forming a bilobal shape and including a central portion positioned centrally between the first foot and the second foot. The central portion forming a cavity. The cavity having a size and a shape corresponding to a handle end of a staple removal tool. The staple removal tool adapted for frictional receipt with the cavity and having a tool end. The tool end having a flattened shape with a tapered end portion and generally corresponding to the width of a crown portion of a staple and adapted to function as a pry member to loosen a fastened staple.

The staple removal tool handle end including a grasping portion allowing a user to easily grab the tool allow for removal from the cavity. The staple removal tool generally integrated within the base portion and allowing a user to utilize the tool to remove jammed or stuck staples from within the magazine or to remove a staple from an object after fastening.

The second end of the base portion further includes an anvil. The anvil positioned adjacent the cavity opposite the first foot and second foot and aligned with an end of a magazine dispensing staples and adapted to provide a stable region for the impact of staples during use.

The arm portion hingedly affixed to the base portion first end at a first end and having a second end opposite the first end. The arm portion second end generally adapted for movement towards the base portion in a direction towards the anvil to impinge a staple for fastening objects during use.

The arm portion including the magazine positioned at an underside of the arm portion and adapted generally as a means to receive staples for fastening within an interior of the magazine.

The arm portion having a viewing region aligned with the interior of the magazine, wherein the viewing region is provided as a means to allow a user to view the magazine interior during use of the device. The viewing region is preferably placed on a top side of the arm portion and constructed out of a transparent material, such as a transparent plastic. Although a viewing region being constructed out of transparent plastic is preferred, other similar materials having transparent or translucent properties may be utilized, such as, but not limited to, glass, films, and polycarbonates.

In an alternate embodiment, the viewing region means may be a slit, slot, aperture, or other similar feature adapted to allow a user of the device a view of the interior portion of the magazine and any placed staples during use.

Preferably the entirety of the arm portion is constructed out of a generally transparent or translucent material, wherein the viewing region generally extends the entire arm portion.

BRIEF DESCRIPTION OF THE SEVERAL VIEWS OF THE DRAWING(S)

The accompanying drawings are included to provide a further understanding of the present invention and are incorporated in and constitute a part of this specification. The drawings illustrate exemplary embodiments of the present invention and together with the description serve to further explain the principles of the invention. Other aspects of the invention and the advantages of the invention will be better appreciated as they become better understood by reference to the Detailed Description when considered in conjunction with accompanying drawings, and wherein.

DETAILED DESCRIPTION OF THE INVENTION

Figure 1:
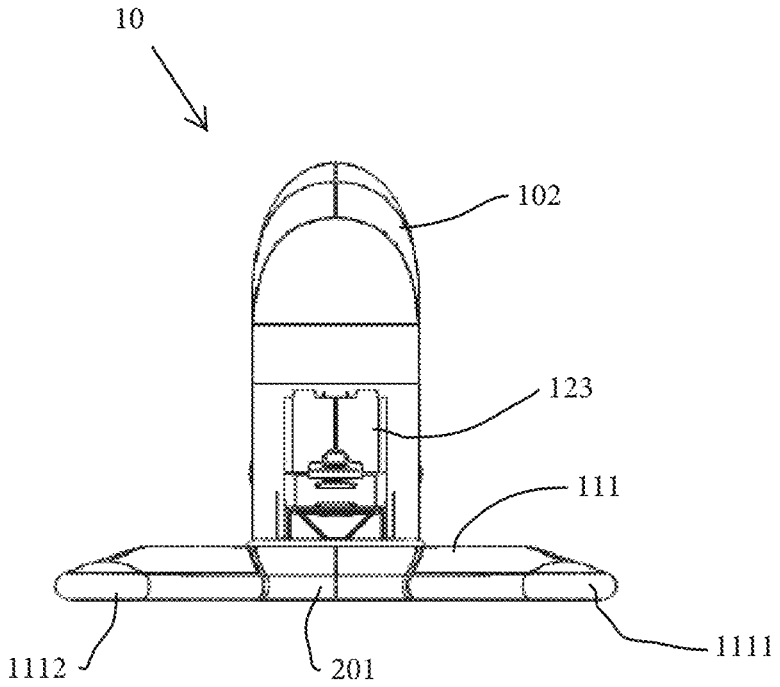
FIG. 1 shows a front side view of the stapler device, according to the present invention.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful, and is not intended to exclude other embodiments from the scope of the invention.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Figure 2:
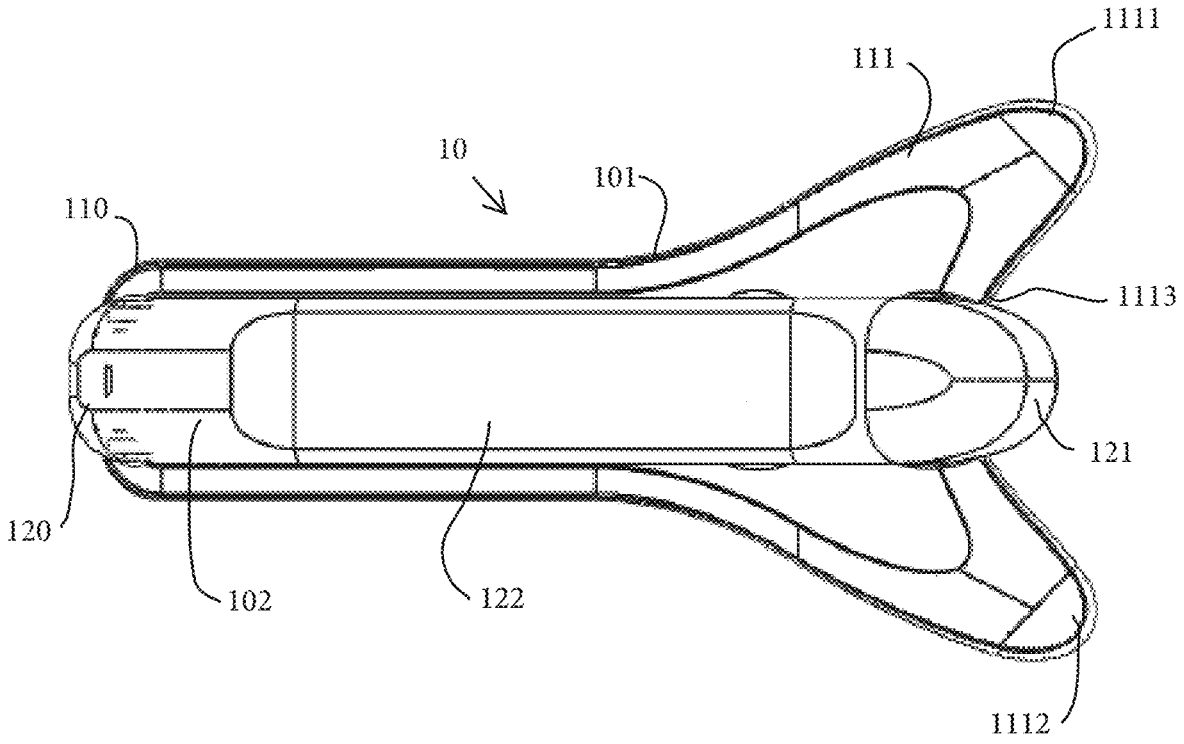
FIG. 2 shows a top view of the stapler device, according to the present invention.
Figure 3:
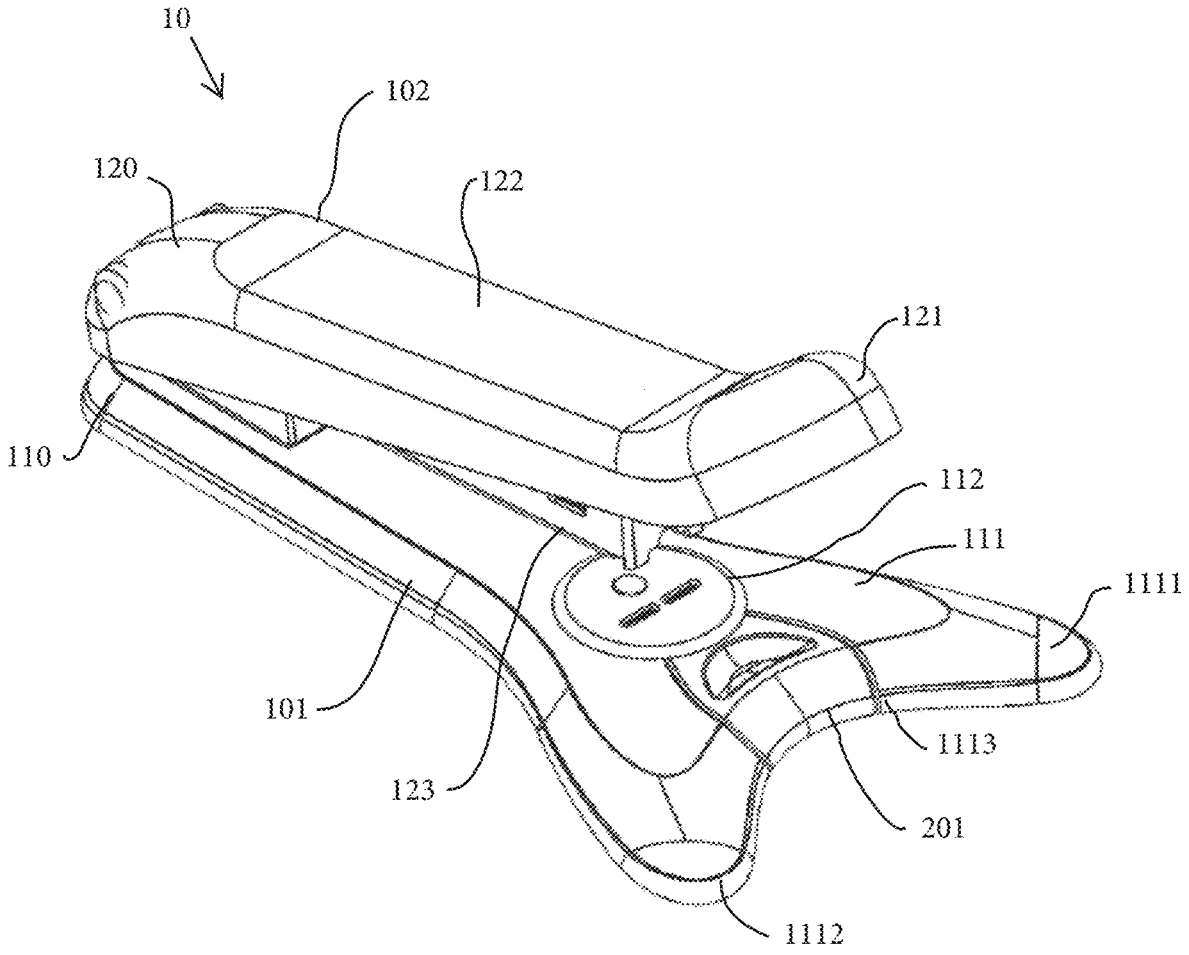
FIG. 3 shows an isometric view of the stapler device, according to the present invention.
Figure 4:
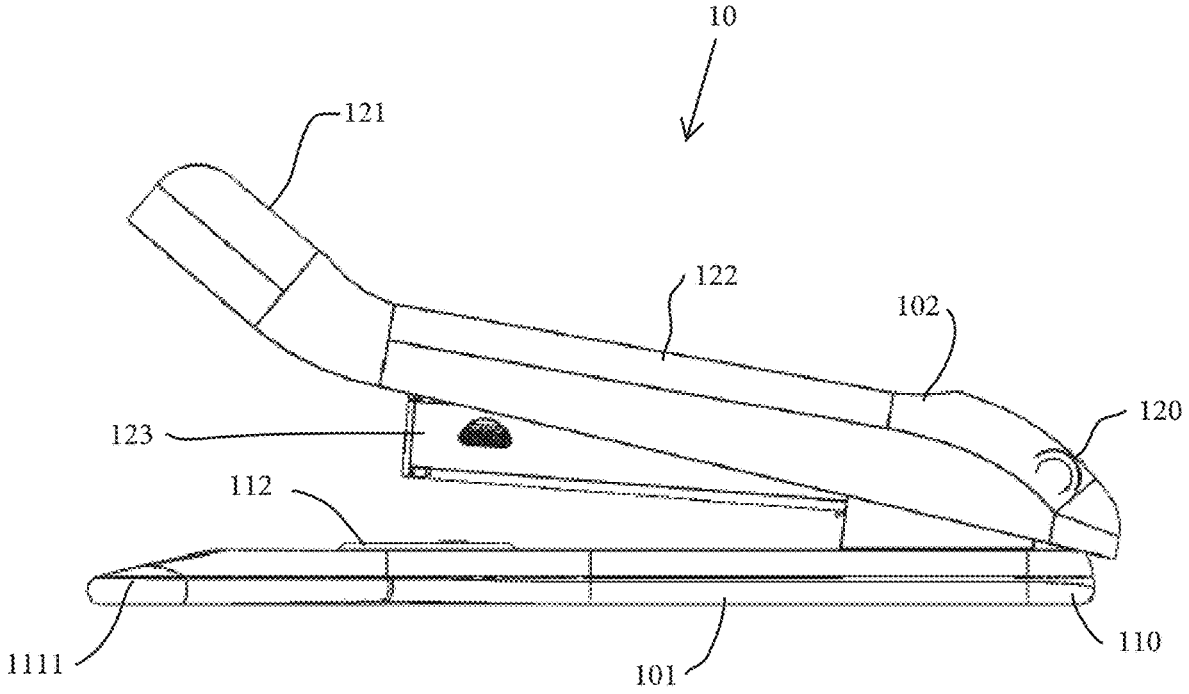
FIG. 4 shows a side view of the stapler device, according to the present invention.
Figure 5:
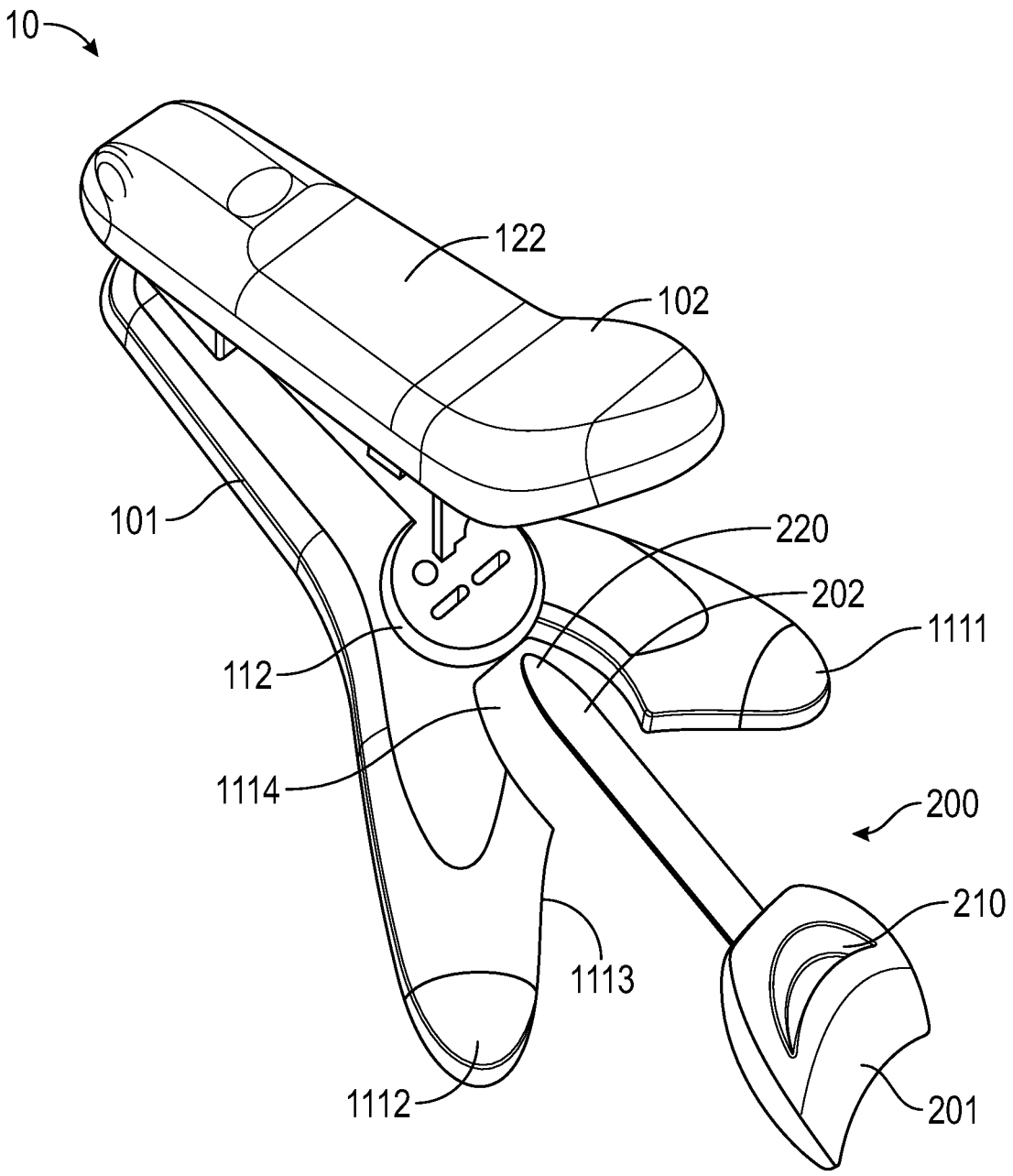
FIG. 5 shows an exploded view of the stapler device and removal tool, according to the present invention.
Figure 6:
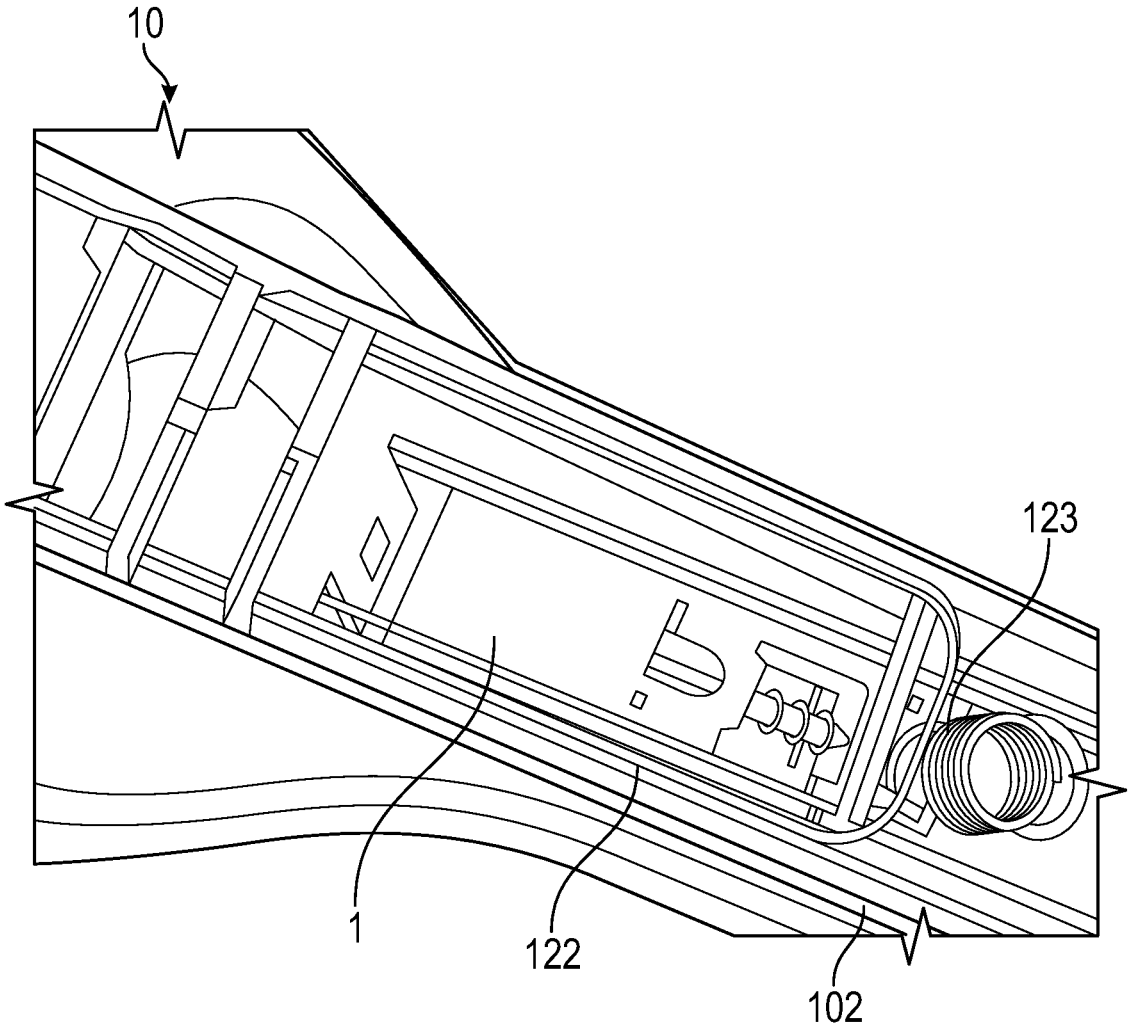
FIG. 6 shows a close up view of the viewing region of the device, according to the present invention.

Referring now to FIGS. 1-6, the present disclosure provides a stapler device, generally referred to as device 10. The device 10 functions mechanically similar to a typical stapler as is found in the prior art, but with at least a portion of the device 10 providing a user of the device 10 a view of an interior portion of the device 10 that can be utilized to view installed staples 1 within the device 10 interior during use.

The device 10 is comprised of a base portion 101 generally adapted to provide resting support for the device 10 during use when placed on a surface and an arm portion 102 in hinged coupling with the base portion 101.

The base portion 101 having a first end 110 and a second end 111 opposite the first end 110 and defining a length of the device 10, wherein the first end 110 is positioned adjacent to the hinged coupling with the arm portion 102.

The second end 111 of the base portion 101 comprising a first foot 1111 and a second foot 1112 the first foot 1111 and the second foot 1112 generally forming a bilobal shape and including a central portion 1113 positioned centrally between the first foot 1111 and the second foot 1112. The central portion 1113 forming a cavity 1114. The cavity 1114 having a size and a shape corresponding to a handle end 201 of a staple removal tool 200. The staple removal tool 200 adapted for frictional receipt with the cavity 1114 and having a tool end 202. The tool end 202 having a flattened shape with a tapered end portion 220 and generally corresponding to the width of a crown portion of a staple 1 and adapted to function as a pry member to loosen a fastened staple 1.

The staple removal tool 200 handle end 201 including a grasping portion 210 allowing a user to easily grab the tool allow for removal from the cavity 1114. The staple removal tool 200 generally integrated within the base portion 101 and allowing a user to utilize the tool 200 to remove jammed or stuck staples 1 from within a magazine 123 or to remove a staple from an object after fastening.

The second end 111 of the base portion 101 further includes an anvil 112. The anvil 112 positioned adjacent the cavity 1114 opposite the first foot 1111 and second foot 1112 and aligned with an end of a magazine 123 dispensing staples 1 and adapted to provide a stable region for the impact of staples 1 during use.

The arm portion 102 hingedly affixed to the base portion 101 first end 110 at a first end 120 and having a second end 121 opposite the first end 120. The arm portion 102 second end 121 generally adapted for movement towards the base portion 101 in a direction towards the anvil 112 to impinge a staple 1 for fastening objects during use.

The arm portion 102 including the magazine 123 positioned at an underside of the arm portion 102 and adapted generally as a means to receive staples 1 for fastening within an interior of the magazine 123.

The arm portion 102 having a viewing region 122 aligned with the interior of the magazine 123, wherein the viewing region 122 is provided as a means to allow a user to view the magazine 123 interior during use of the device 10. The viewing region 122 is preferably placed on a top side of the arm portion 102 and constructed out of a transparent material, such as a transparent plastic. Although a viewing region 122 being constructed out of transparent plastic is preferred, other similar materials having transparent or translucent properties may be utilized, such as, but not limited to, glass, films, and polycarbonates.

In an alternate embodiment, the viewing region 122 means may be a slit, slot, aperture, or other similar feature adapted to allow a user of the device 10 a view of the interior portion of the magazine 123 and any placed staples 1 during use.

Preferably the entirety of the arm portion 102 is constructed out of a generally transparent or translucent material, wherein the viewing region 122 generally extends the entire arm portion 102. Accordingly, the arm portion 102 could be constructed out of a generally durable and rigid plastic material that is substantially transparent. The arm portion 102 could be provided in a plurality of colors of this generally transparent plastic material.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) but that the invention will include all embodiments falling with the scope of the appended claims.

What is claimed is:

1. A stapler, the stapler adapted to receive staples for fastening an object, the stapler comprising:

a base portion, the base portion having a first end and a second end opposite the first end, the second end having a first foot, a second foot, and a central portion positioned between the first foot and the second foot, the central portion defining a cavity;

an arm portion, the arm portion hingedly received on the first end of the base portion, the arm portion including a magazine, the magazine positioned within the aim portion and having an interior adapted to receive the staples;

a viewing region, the viewing region aligned with the interior of the magazine, wherein the viewing region allows a user to view the interior of the magazine through an exterior of the arm portion; and a staple removal tool, the staple removal tool integrated into the cavity of the base portion, the staple removal tool including: a handle end; and a tool end, the tool end extending opposite the handle end and extending a length to a tapered end portion, the tool end having a flattened shape corresponding to width of a crown of a staple placed within the stapler.

2. A stapler, the stapler adapted to receive staples for fastening an object, the stapler comprising:

a base portion, the base portion having a first end and a second end opposite the first end, the second end having a first foot, a second foot, and a central portion positioned between the first foot and the second foot, the central portion defining a cavity;

an arm portion, the arm portion hingedly received on the first end of the base portion, the arm portion including a magazine, the magazine positioned within the arm portion and having an interior adapted to receive the staples;

a viewing region, the viewing region aligned with the interior of the magazine, wherein the viewing region allows a user to view the interior of the magazine through an exterior of the arm portion; and a staple removal tool, the staple removal tool received within the cavity of the base portion the staple removal tool including:

a handle end; and a tool end, the tool end extending opposite the handle end and extending a length to a tapered end portion, the tool end having a flattened shape corresponding to width of a crown of a staple placed within the stapler.

* * * * *